US012618193B2

(12) United States Patent
Jiang et al.

(10) Patent No.: US 12,618,193 B2
(45) Date of Patent: May 5, 2026

(54) METHOD FOR PREPARING ANTIMICROBIAL TREATMENT AGENT FOR TEXTILE

(71) Applicant: Shanghai Prosheldor Sci. & Tech. Co., Ltd, Shanghai (CN)

(72) Inventors: Chanjuan Jiang, Shanghai (CN); Haibin Gu, Shanghai (CN)

(73) Assignee: Shanghai Prosheldor Sci. & Tech. Co., Ltd, Shanghai (CN)

( * ) Notice: Subject to any disclaimer, the term of this patent is extended or adjusted under 35 U.S.C. 154(b) by 339 days.

(21) Appl. No.: 18/033,349

(22) PCT Filed: Dec. 3, 2020

(86) PCT No.: PCT/CN2020/133670
§ 371 (c)(1),
(2) Date: Apr. 23, 2023

(87) PCT Pub. No.: WO2022/099827
PCT Pub. Date: May 19, 2022

(65) Prior Publication Data

US 2023/0407557 A1 Dec. 21, 2023

(30) Foreign Application Priority Data

Nov. 12, 2020 (CN) ..... 202011261192.3

(51) Int. Cl.

| | |
|---|---|
| ***D06M 11/56*** | (2006.01) |
| ***D06M 11/38*** | (2006.01) |
| ***D06M 11/60*** | (2006.01) |
| ***D06M 11/62*** | (2006.01) |
| ***D06M 11/76*** | (2006.01) |
| ***D06M 13/148*** | (2006.01) |
| ***D06M 15/03*** | (2006.01) |
| ***D06M 15/53*** | (2006.01) |
| *D06M 101/06* | (2006.01) |
| *D06M 101/32* | (2006.01) |
| *D06M 101/34* | (2006.01) |

(52) U.S. Cl.
CPC ..... *D06M 11/56* (2013.01); *D06M 11/38* (2013.01); *D06M 11/60* (2013.01); *D06M 13/148* (2013.01); *D06M 15/53* (2013.01); *D06M 2101/06* (2013.01); *D06M 2101/32* (2013.01); *D06M 2101/34* (2013.01)

(58) Field of Classification Search
CPC ..... D06M 11/56; D06M 11/38; D06M 11/60; D06M 13/148; D06M 11/62; D06M 11/13; D06M 15/03
See application file for complete search history.

(56) References Cited

U.S. PATENT DOCUMENTS

| | | | | |
|---|---|---|---|---|
| 2010/0126525 | A1 | 5/2010 | Nagai et al. | |
| 2011/0020591 | A1* | 1/2011 | Nakamura | D06M 15/277 442/80 |
| 2019/0218710 | A1 | 7/2019 | Chang | |

FOREIGN PATENT DOCUMENTS

| | | | | |
|---|---|---|---|---|
| CN | 1159488 | C | | 2/2002 |
| CN | 1335426 | A | | 2/2002 |
| CN | 104762810 | A | | 7/2015 |
| CN | 108048933 | | * | 5/2018 |
| CN | 108048933 | A | * | 5/2018 |
| CN | 109440450 | A | | 3/2019 |
| CN | 109487558 | A | | 3/2019 |

* cited by examiner

*Primary Examiner* — Mina Haghighatian

(57) ABSTRACT

The present invention provides a method for preparing an antimicrobial treatment agent for textiles, including steps of: (S1) providing substances of: (a) divalent copper ion salt; (b) ammonia water or ammonium salt; (c) an inorganic alkaline aqueous solution; (d) an organic substance of alcohols or carbohydrates containing only carbon, hydrogen and oxygen elements; (e) water; and (S2) mixing and ageing above solutions using alcohols or carbohydrates as a catalyst to form a compound of a copper ammonium complex. In the method for preparing an antimicrobial treatment agent for textiles of the present invention, the treatment agent does not contain a heavy metal or an organic element that may have toxicity, for example, nitrogen, phosphorus or sulfur, an alkaline material used for treating the textile does not contain a non-volatile or an organic amine compound, an organic substance such as alcohols or carbohydrates is skillfully used as a catalyst, and copper ions form a complex for transition, so that natural textile fibers are grafted to copper ions more tightly and have advantages of safety, environmental friendliness, scrub resistance, a high antibacterial effect and long life of service.

3 Claims, No Drawings

METHOD FOR PREPARING ANTIMICROBIAL TREATMENT AGENT FOR TEXTILE

CROSS-REFERENCE TO RELATED APPLICATIONS

This present application is a National Stage application of International Patent Application No. PCT/CN2020/133670, filed on Dec. 3, 2020, which claims the priority of China Invention Patent Application No. 202011261192.3, entitled "METHOD FOR PREPARING ANTIMICROBIAL TREATMENT AGENT FOR TEXTILE" filed on Nov. 12, 2020. The contents of all above applications are incorporated herein by reference in their entirety.

FIELD OF THE INVENTION

The present invention relates to the technical field of antimicrobial composite materials, specifically to a method for preparing an antimicrobial treatment agent for textiles.

BACKGROUND

With continuous improvement of consumption and living standards in China, higher requirements are imposed on quality of various textiles. Cotton fabrics originated from natural sources are soft and comfortable to wear, but have poor antibacterial and mildew resistance, which can easily result in microbial growth thereon and cause a great risk to human health. Microorganisms can parasitize and grow on textiles, which also reduces service life of textiles and makes the textiles become carriers for microbial spreading. Antimicrobial treatment agents for the textiles can reduce the growth of microorganisms on the textiles, to improve durability of the textiles, reduce the number of washing times, reduce infections caused by microorganisms, better protect the environment, and improve human health.

Because the antimicrobial materials often cause risks to the natural environment and human safety, environmental protection and human safety issues of the antimicrobial materials have attracted increasingly attention. Inorganic antibacterial agents based on metal elements such as silver, mercury, lead, arsenic, tin and zinc, and antibacterial agents including organic substances and metals can pollute the human body and the environment, and especially have persistent high toxicity to soil and water bodies. Organic antimicrobial treatment agents such as Triclosan, Chlorothalonil and isothiazolinone usually have serious impact on human health.

Widely existing in the human body, soil and water, copper ions are a safe and environmentally friendly antibacterial element. However, in the prior art, due to colors, complexes of copper ions, they cannot directly act on the textiles or have any washing fastness on the textiles, which greatly limits application of copper ions.

SUMMARY

To resolve technical problems mentioned in Background, an inventive purpose of the present invention is to provide a method for preparing an antimicrobial treatment agent for textiles, where the treatment agent does not contain a heavy metal or an organic element that may have toxicity, for example, nitrogen, phosphorus or sulfur. The inventor notices that an alkaline material used for treating the textiles does not contain a non-volatile or an organic amine compound, and thus, an organic substance such as alcohols or carbohydrates is skillfully used as a catalyst, and copper ions form a complex for transition, so that natural textile fibers are grafted to copper ions more tightly. Thus, the obtained antimicrobial treatment agent has advantages of safety, environmental friendliness, scrub resistance, a high antibacterial effect and long duration.

Specifically, the present invention provides a method for preparing an antimicrobial treatment agent for a textile, including steps of:

Step S1 providing below substances:

(a) salt containing divalent copper ion;

(b) ammonia water or ammonium salt;

(c) an inorganic alkaline aqueous solution;

(d) an organic substance of alcohols or carbohydrates containing only carbon, hydrogen and oxygen elements; and (e) water;

Step S2 mixing and ageing the above solutions using alcohol or carbohydrate as a catalyst to form a compound of a copper ammonium complex.

Further, said ammonium salt includes one or more of below substances ammonium chloride, ammonium nitrate, ammonium sulfate, ammonium citrate and ammonium acetate.

Further, said inorganic alkaline aqueous solution includes an aqueous solution of one or more of below substances: sodium carbonate, sodium acetate, sodium hydroxide and potassium hydroxide.

Further, said organic substance of alcohols or carbohydrates includes one or more of below substances: methanol, ethanol, propylene glycol, glycerol, butanol, polyethylene glycol, glucose, an oligosaccharide and polysaccharide.

Further, more than four kinds of organic substances of alcohols or carbohydrates from above alcohols or carbohydrates substances are used as catalysts, to form a copper ion antimicrobial treatment agent in which divalent copper ions have good binding fastness with the textiles.

Further, said salt containing divalent copper ion is copper sulfate, said inorganic alkaline aqueous solution is sodium hydroxide, said organic substances are ethanol, glycerol, propylene glycol, polyethylene glycol, and glucose; the part and percentage of raw materials below are measured by weight, the textile adopts cellulose fiber fabrics, chemical fiber fabrics, regenerated fabrics, protein fabrics, or the like, cellulose fiber fabrics includes chemical fiber, polyester cotton, nylon, spandex, acrylic fiber, viscose, tencel, silk, or the like, and raw materials of said antimicrobial treatment agent comprise parts of 50% copper sulfate aqueous solution, 2.9 parts of 28% ammonium hydroxide, parts of 10% sodium hydroxide aqueous solution, 0.3 parts of ethanol, 1 part of glycerol, 3 parts of propylene glycol, 1 part of polyethylene glycol, 1.6 parts of glucose, and 80 parts of water.

Working principle of the method of the present invention is: it is known that a cupric ammonia solution can undergo a coordination reaction with a hydroxyl group in natural cellulose to form a stable cupric ammonia ion complex fiber, which has a specific antibacterial function. Content of copper ions firmly bonded on the fabrics is an important indicator of antibacterial performance of the fabrics, but if a concentration of the cupric ammonia solution is too high, mechanical performance of fabric cellulose is compromised. In the present invention, the organic substance such as alcohols or carbohydrates is creatively used together with copper ions to form the complex for transition, which significantly increases the amount of copper ions grafted on cellulose without compromising the performance of cellulose, so that the fabric can be treated at room temperature and the treated fabric not only has high scrub resistance, but also has high antibacterial performance and long duration.

Technical effects of the present invention include: (1) in the method of the present invention, basic ammonium used for treating or forming a transitive complex with copper ions does not remain on the textiles after washing, and the raw materials only contain three elements of carbon, hydrogen and oxygen, and contain no organic element that may have toxicity, for example, nitrogen, phosphorus or sulfur, and contains no metal element that may have toxicity, for example, silver, mercury, lead, arsenic or tin, and therefore, the raw materials are highly safe; (2) in the obtained antimicrobial treatment agent, no non-volatile or organic amine compound that may harm the environment is contained, and biologically active metal ions only contain copper ions which are environmentally friendly, and no other biologically active metal ions is contained, thereby ensuring properties of non-toxicity and environmental friendliness; (3) the organic substance such as alcohol or carbohydrate is skillfully used with copper ions to form the complex for transition, so that the copper ions are more firmly grafted on natural textile fibers, thereby ensuring a good scrub resistance, high antibacterial effect and long duration; (4) the antimicrobial treatment agent prepared by the method of the present invention can be used to treat the fabrics at room temperature, which is unavailable in the prior art. The method of the present invention can significantly increase binding strength, density and content of copper ions without a complex treatment process or condition. The antimicrobial treatment agent prepared by the method of the present invention is highly applicable to various field, and a user can treat the fabric under a relatively simple condition; and (5) content of ammonium hydroxide in the antimicrobial treatment agent prepared by the method of the present invention is 2.9%, and combining glycerol, propylene glycol, ethanol, polyethylene glycol, and glucose into a catalyst can ensure that measured antibacterial rates against *Staphylococcus aureus* after 50 times and 20 times of washing are both greater than 99%.

DETAILED DESCRIPTION

Some embodiments of the present invention are described below. Unless otherwise specified, all fractions and percentages illustrated in the following specific embodiments are measured by weight.

Embodiment 1

10.1 parts of copper sulfate (50%), 2.9 parts of ammonium hydroxide (28%), 0.1 parts of sodium hydroxide aqueous solution (10%), 0.3 parts of ethanol, 1 part of glycerol, 3 parts of propylene glycol, 1 part of polyethylene glycol, 1.6 parts of glucose, and 80 parts of water were taken.

Reagents of copper sulfate, ammonium hydroxide, sodium hydroxide, propylene glycol, glycerol, and polyethylene glycol were prepared respectively in the above mentioned ratio, each of above reagents were dissolved and aged for 10 hours separately, mixed, maintained at 30° C.-35° C., stirred, and further aged for 24 hours to obtain an antimicrobial treatment agent. Herein, ethanol, glycerol, propylene glycol, polyethylene glycol and glucose were in a ratio of 0.3:1:3:1:1.6, pre-mixed and purified for 1 hour to obtain an organic substance of alcohol as a catalyst to well stabilize copper ions for transition.

Embodiment 2

10.1 parts of copper sulfate (50%), 2.9 parts of ammonium hydroxide (28%), 0.1 parts of sodium hydroxide aqueous solution (10%), 3 parts of ethanol, 3 part of glycerol, 4 parts of propylene glycol, 3 part of polyethylene glycol, 9.9 parts of glucose, and 64 parts of water were taken.

Reagents of copper sulfate, ammonium hydroxide, sodium hydroxide, propylene glycol, glycerol, and polyethylene glycol were prepared respectively in the above mentioned ratio, each of the reagents was dissolved and aged for 10 hours separately, mixed, maintained at 30° C.-35° C., stirred, and further aged for 24 hours to obtain an antimicrobial treatment agent. Herein, ethanol, glycerol, propylene glycol, polyethylene glycol and glucose were in a ratio of 3:1:5:1:9.9.

Embodiment 3

10.1 parts of copper sulfate (50%), 2.9 parts of ammonium hydroxide (28%), 0.1 parts of sodium hydroxide aqueous solution (10%), 1.9 parts of ethanol, 3 part of glycerol, 20 parts of propylene glycol, 3 part of polyethylene glycol, 10 parts of glucose, and 49 parts of water were taken.

Reagents of copper sulfate, ammonium hydroxide, sodium hydroxide, propylene glycol, glycerol, and polyethylene glycol were prepared respectively in the above mentioned ratio, each of the reagents was dissolved and aged for 10 hours separately, mixed, maintained at 30° C.-35° C., stirred, and further aged for 24 hours to obtain an antimicrobial treatment agent. Herein, ethanol, glycerol, propylene glycol, polyethylene glycol and glucose were in a ratio of 1.9:3:20:3:10.

Embodiment 4

10.1 parts of copper sulfate (50%), 4.8 parts of ammonium hydroxide (28%), 0.1 parts of sodium hydroxide aqueous solution (10%), 2 parts of ethanol, 3 part of glycerol, 13 parts of propylene glycol, 3 part of polyethylene glycol, 10 parts of glucose, and 54 parts of water were taken.

Reagents of copper sulfate, ammonium hydroxide, sodium hydroxide, propylene glycol, glycerol, and polyethylene glycol were respectively prepared. Each of the reagents was dissolved and aged for 10 hours separately, mixed, maintained at 30° C.-35° C., stirred, and further aged for 24 hours to obtain an antimicrobial treatment agent. Herein, ethanol, glycerol, propylene glycol, polyethylene glycol and glucose were in a ratio of 2:3:13:3:10.

Textiles can be treated with the antimicrobial treatment agent prepared by the method of the present invention include cellulose fiber fabrics, chemical fibers, renewable fibers, viscose and the like. Specific treatment processes include dipping, padding, spraying, coating, and foam coating processing. (1) Dipping: dipping can also be called as soaking. After pretreatment, dyeing and washing of the fabrics were completed, at room temperature or 40° C., the microbial treatment agent was added to a dyeing vat at room temperature and atmospheric pressure, the fabrics can be removed from the dyeing vat after the dyeing vat was kept therein for 10 minutes, and the fabrics were dehydrated and dried. (2) padding: after the fabrics were dyed, washed and dried, the microbial treatment agent was evenly applied to the fabrics via one dipping treatment and one rolling treatment under pressure of 1.8 kg-4 kg, followed by curing and drying at a drying temperature of 100° C.-150° C., so that the fabrics react with the microbial treatment agent, thereby completing processing of the fabrics with the microbial treatment agent. (3) spraying: spraying is used for special products that cannot be soaked or padded but can only be subjected to a spraying process such as filling with an atomizing nozzle, and after spraying, the special product was dried at drying temperature of 100° C.-150° C. (4) coating process: a required amount of agent that needs to be subjected to the coating process was mixed with coating slurry, and applied to surfaces of the fabrics, followed by drying for cross-linking. (5) foam coating: performing foam coating can save water, a foaming agent and the antimicrobial treatment agent were used to form foam, followed by scraping coating and drying at drying temperature of 100° C.-150° C., and this process can save a lot of water and reduce a waste of energy.

In the foregoing four examples, when a concentration of ammonium hydroxide in the antimicrobial treatment agent prepared by the method of the present invention is increased, bounding fastness during washing of the antimicrobial treatment agent and fabric decreases. Ammonium hydroxide was prepared at different concentrations, other conditions were kept unchanged, the fabrics were washed after being treated with 3% antimicrobial treatment agent, and an antibacterial rate against *Staphylococcus aureus* was measured. Results are shown in the following table:

| Percentage of 28% ammonium hydroxide (percentage) | Measured antibacterial rate against *Staphylococcus aureus* after 50 times of washing (percentage) | Measured antibacterial rate against *Staphylococcus aureus* after 20 times of washing (percentage) |
|---|---|---|
| 2.9% | Greater than 99.9% | Greater than 99.9% |
| 9% | 60% | 99% |
| 16% | 30% | 50% |

In addition, using glucose as a catalyst facilitates washing fastness of the antimicrobial treatment agent and the fabrics, using different or combined catalysts facilitates washing fastness of a bound microbial treatment agent and fabric, other conditions were kept unchanged, the fabrics were washed after being treated with 3% antimicrobial treatment agent, and an antibacterial rate against *Staphylococcus aureus* was measured. Results are shown in the following table:

| Different catalysts | Measured antibacterial rate against *Staphylococcus aureus* after 50 times of washing (percentage) | Measured antibacterial rate against *Staphylococcus aureus* after 20 times of washing (percentage) |
|---|---|---|
| Glucose | 60% | 99% |
| Glycerol | 50% | 96% |
| Polyethylene glycol | 60% | 90% |
| Glycerol, propylene glycol, ethanol, polyethylene glycol and glucose | 99.9% | 99.9% |

The following treatment examples show treatment results of various fabrics with the antimicrobial treatment agent (Example 1) prepared by the method of the present invention, and comparison between fabric treatment performance of the antimicrobial treatment agent of the present invention and that of a treatment agent in the prior art.

Example 1: Taking treatment of cotton yarn as example, a dipping process was performed, an agent of 2% (o.w.f) was added to an auxiliary vat, and 2 kg of antibacterial agent was required for 100 kg of yarn.

| | Silver ion antibacterial agent | Triclosan antibacterial agent | Antimicrobial treatment agent of the present invention |
|---|---|---|---|
| Processing efficiency | Needed to heat to 50° C. and process for at least 1.5 hours | Needed to heated to 60° C., maintained for 30 minutes | Room temperature, maintained for 10 minutes |

-continued

| | Silver ion antibacterial agent | Triclosan antibacterial agent | Antimicrobial treatment agent of the present invention |
|---|---|---|---|
| Washability (FZ/T73023) | 20 times of washing | 10 times of washing | 50 times of washing |
| Inhibition zone | Less than 5 mm | Greater than 5 mm | 0 |
| Antibacterial rate after 50 times of washing (GB/T20944.3) | 60% | 0 | Greater than 99.9% against *Staphylococcus aureus* and *Escherichia coli* |

Example 2: Socks, a knitted cotton fabric, an underwear, and a T-shirt fabric were subjected to a dipping process. An agent accounting for 2% (o.w.f) was added to an auxiliary vat, and 2 kg of antibacterial agent was required for 100 kg of fabric. The agent was added at room temperature (the room temperature in a factory was generally 35° C.-40° C.), and the temperature was maintained for 10 minutes.

| | Antimicrobial treatment agent of the present invention |
|---|---|
| Washability (FZ/T73023) | 50 times of washing |
| Inhibition zone | 0 |
| Antibacterial rate after 50 times of washing (GB/T20944.3) | Greater than 99.9% against *Staphylococcus aureus* and *Escherichia coli* |

Example 3: A towel was subjected to a dipping process. An agent accounting for 2% (o.w.f) was added to an auxiliary vat, and 2 kg of antibacterial agent was required for 100 kg of fabrics. The agent was added at room temperature (the room temperature in a factory was generally 35° C.-40° C.), and the temperature was maintained for 10 minutes.

| | Silver ion antibacterial agent | Silicone quaternary ammonium salt | Antimicrobial treatment agent in the present invention |
|---|---|---|---|
| Processing efficiency | The dipping process failed and therefore, was unavailable, and only padding process could be performed, which was a limitation. | Needed to heat to 50° C., maintained for 30 minutes | Room temperature, maintained for 10 minutes |
| Washability (FZ/T73023) | 20 times of washing | 10 times of washing | 50 times of washing |
| Inhibition zone | Less than 5 mm | Greater than 5 mm | 0 |
| Antibacterial rate after 50 times of washing (GB/T20944.3) | 60% | 0 | Greater than 99.9% against *Staphylococcus aureus* and *Escherichia coli* |
| Appearance | Towel was not fluffy after padding. | Water absorption affected | No impact |

Example 4: Home fabrics such as cotton, viscose, polyester, nylon, and blended fabrics were subjected to a padding process. An agent accounting for 2% (o.w.f) of the fabrics was added, after a liquid retention ratio was calculated, the agent was configured at a concentration, in which 2 kg of antibacterial agent was required for 100 kg of fabrics. The fabrics were subjected to a padding process, drying, curing and finishing.

| | Antimicrobial treatment agent in the present invention |
|---|---|
| Standard FZ/T73023-AAA | 50 times of washing |
| Inhibition zone | 0 |
| Antibacterial rate after 50 times of washing (GB/T20944.3) | Greater than 99.9% against *Staphylococcus aureus* and *Escherichia coli* |

Example 5: Sportswear fabrics such as cotton, viscose, polyester and nylon were subjected to a padding process. An agent accounting for 2% (o.w.f) of the fabric was added, after a liquid retention ratio was calculated, the agent was configured at a concentration, i.e., 2 kg of antibacterial agent was required for 100 kg of fabric. The fabric was subjected to a padding process, drying, curing and finishing.

Test: After 50 times of washing, both antibacterial rates of *Staphylococcus aureus* and *Escherichia coli* were 99%.

Example 6: Work cloth fabrics were subjected to a padding process. For example, cotton, viscose, polyester and nylon were subjected to a padding process. An agent accounting for 2% (o.w.f) of the fabric was added, after a liquid retention ratio was calculated, the agent was configured at a concentration. That is, 2 kg of antibacterial agent was required for 100 kg of fabric. The fabric was subjected to a padding process, drying, curing and finishing.

Test: After 50 times of washing, both antibacterial rates of *Staphylococcus aureus* and *Klebsiella pneumoniae* tested according to AATCC100-2019 were 99%.

Example 7: Knitted fabrics for respirators were subjected to a padding process. An agent accounting for 2% (o.w.f) was added to an auxiliary vat, and 2 kg of antibacterial agent was required for 100 kg of fabric. The agent was added at room temperature (room temperature in a factory was generally 35° C.-40° C.), and the temperature was maintained for 10 minutes. The respirator was removed from the vat, followed by dehydration, drying, padding and three-proofing (water repellency, oil repellency and antifouling), and the antibacterial and three-proofing functions were completed.

Test: An antibacterial effect was measured according to AATCC135. After 30 times of washing, both antibacterial rates of *Staphylococcus aureus* and *Klebsiella pneumoniae* tested according to AATCC100-2019 were 99%.

Three-proofing effects: water repellency scores were 100 points before washing, and points after 30 times of washing. Oil repellency was level 5 before oil washing, and level 3.5 after oil washing.

This example resolved a problem that tens thousand meter large-scale production process cannot be achieved due to a conflict between antibacterial and three-proofing treatments in the past. In addition, the antibacterial treatment was completed in the vat without increasing costs for a factory. This example also resolved a problem that the antibacterial and three-proofing treatments required two curing treatments in the past, which causes a waste of energy and low production efficiency.

Example 8: Shirt fabrics were subjected to a padding process. For example, cotton, viscose, polyester and nylon were subjected to a padding process. An agent accounting for 2% (o.w.f) of the fabrics was added, after a liquid retention ratio was calculated, the agent was configured at the calculated concentration, that is, 2 kg of antibacterial agent was required for 100 kg of fabric. The fabric was subjected to a padding process, drying, curing and finishing.

Test: After 50 times of washing, both antibacterial rates of *Staphylococcus aureus* and *Klebsiella pneumoniae* tested according to AATCC100-2019 were 99%.

In this example, shirts were mostly white, a silver ion antibacterial agent was used in the past, the fabrics are easy to turn yellow during storage, the triclosan antibacterial agent has a safety problem, and washability cannot be achieved via a silicone quaternary ammonium salt antibacterial agent. After the treatment with the antimicrobial treatment agent of the present invention, a color hardly changed after storage, no antibacterial agent remained, and washability could be 50 times of washing.

Example 9: Jeans fabrics were subjected to a padding process. Components such as cotton, viscose, polyester and nylon were subjected to a padding process. An agent accounting for 2% (o.w.f) of the fabric was added, after a liquid retention ratio was calculated, the agent was configured at the calculated concentration, that is, 2 kg of antibacterial agent was required for 100 kg of fabrics. The fabrics were subjected to a padding process, drying, curing and finishing. The antimicrobial treatment agent may also be applied when jeans yarns were starched, and added together with yarn starch.

Test: After 50 times of washing, both antibacterial rates of *Staphylococcus aureus* and *Klebsiella pneumoniae* tested according to ISO20743-2013 were 99%.

The present invention resolved a problem of antibacterial failure when the antibacterial agent was mixed with indigo dyes and sulfur dyes in the yarn, and also resolved a problem of a lack of an antibacterial effect because 80% of the antibacterial agent fell off after the jeans fabric was washed with an enzyme.

Example 10: Gauze and rag fabrics. An agent accounting for 2% (o.w.f) of the gauze was added, and 2 kg of antibacterial agent was required for 100 kg of the gauze fabrics. After starch slurry was boiled, the antibacterial agent was directly added to the boiled starch slurry, and the gauze was subjected to padding, drying and finishing.

Test: After 50 times of washing, all antibacterial rates of *Staphylococcus aureus, Escherichia coli* and *Candida albicans* tested according to FZ/T73023-AAA were greater than 99%.

This example resolved a problem that no antibacterial agent could be used in the same bath with starch slurry in the past, which induces high process costs because padding and drying needs to be performed twice. The present invention reduces energy consumption.

Example 11: For filling of short fibers, a spraying process was performed, an agent accounting for 2% (o.w.f) of the gauze was added, and 2 kg of antibacterial agent was required for 100 kg of the short fibers. After a spraying rate was calculated, the required agent was configured in a batching tank, that is, 2 kg of antibacterial agent was required for 100 kg of the short fibers. The short fibers were subjected to spraying and drying.

Example 12: Dyeing of cotton fibers. An agent accounting for 2% (o.w.f) was added to an auxiliary vat of the dyeing vat, and 2 kg of antibacterial agent was required for 100 kg of fibers. The agent was added at room temperature (room temperature in a factory was generally 35° C.-40° C.), and the temperature was maintained for 10 minutes.

After 50 times of washing, all antibacterial rates of *Staphylococcus aureus, Escherichia coli* and *Candida albicans* tested according to FZ/T73023-AAA were greater than 99%.

This example resolved an antibacterial problem of cotton fibers. In the past, an antibacterial effect was easily unfulfilled and unstable when an antibacterial process was performed on the fibers. Only polyester-cotton blends could be used to achieve the antibacterial effect on polyester fibers, and the antibacterial process was not performed on cotton fibers. In the present invention, using 100% treated antibacterial fibers or adding 50% non-antibacterial fibers can achieve good antibacterial performance Starting a treatment from the fibers reduced a need to deliver the fabrics to a dyeing factory. After the fibers were treated, various finished products could be produced by spinning, thereby reducing transportation and energy consumption.

Example 13: Polar fleece fabrics in outdoor clothing. An agent accounting for 2% (o.w.f) was added to an auxiliary vat, and 2 kg of antibacterial agent was required for 100 kg of fabric. The agent was added at room temperature (room temperature in a factory was generally 35° C.-40° C.), and the temperature was maintained for 10 minutes.

| | Antimicrobial treatment agent of the present invention |
|---|---|
| After 10 times of washing | 99.9% against *Staphylococcus aureus* measured according to AATCC100-2019 |

This example resolved a problem that the antibacterial agent could only be used in a padding process in the past, which made the polar fleece fabric difficult to dry and required more than twice amount of energy because the polar fleece fabric was too thick. This example also resolved a problem that there was no batching tank on drying equipment of some polar fleece fabric factories and no additional function could be completed.

Although the present invention has been disclosed above through preferred embodiments, the embodiments are not intended to limit the present invention. Any equivalent changes or modifications made without departing from the spirit and scope of the present invention shall also fall within the protection scope of the present invention. Therefore, the protection scope of the present invention should be based on content defined in claims of the present application.

The invention claimed is:

1. A method for preparing an antimicrobial treatment agent for a textile, wherein the method includes steps of:

Step S1 providing below substances:

(a) 50% copper sulfate aqueous solution, wherein weight of copper sulfate is 50% of total weight of copper sulfate aqueous solution;

(b) 28% ammonia hydroxide aqueous solution, wherein weight of ammonia hydroxide is 28% of total weight of ammonia hydroxide aqueous solution;

(c) 10% sodium hydroxide aqueous solution, wherein weight of sodium hydroxide is 10% of total weight of the sodium hydroxide aqueous solution;

(d) a mixture, which includes: ethanol, glycerol, propylene glycol, polyethylene glycol, and glucose; and (e) water;

Step S2 mixing and ageing the above substances using alcohol or carbohydrate as a catalyst to form a compound of a copper ammonium complex.

2. The method for preparing an antimicrobial treatment agent for a textile according to claim 1, wherein the weight ratio of ethanol, glycerol, propylene glycol, polyethylene glycol, and glucose is 0.3:1:3:1:1.6, 3:1:5:1:9.9, or 1.9:3:20:3:10.

3. The method for preparing an antimicrobial treatment agent for a textile according to claim 1, wherein an amount of the 50% copper sulfate aqueous solution is 10.1 parts by weight, amount of aqueous solution of ammonia hydroxide is 2.9 parts by weight, amount of 10% sodium hydroxide aqueous solution is 0.1 part by weight, amount of ethanol is 0.3 part by weight, amount of glycerol is 1 part by weight, amount of propylene glycol is 3 parts by weight, amount of polyethylene glycol is 1 part by weight, and amount of glucose is 1.6 part by weight, amount of water is 80 parts by weight, wherein the total parts is 100.

* * * * *